US008109478B2

(12) United States Patent
Tristao

(10) Patent No.: US 8,109,478 B2
(45) Date of Patent: Feb. 7, 2012

(54) METHOD AND APPARATUS FOR STABILIZING A STANDING INFANT

(76) Inventor: Evelyn Tristao, Milford, CT (US)

( * ) Notice: Subject to any disclaimer, the term of this patent is extended or adjusted under 35 U.S.C. 154(b) by 0 days.

(21) Appl. No.: 12/807,156

(22) Filed: Aug. 30, 2010

(65) Prior Publication Data

US 2011/0073720 A1 Mar. 31, 2011

Related U.S. Application Data

(60) Provisional application No. 61/277,874, filed on Sep. 30, 2009.

(51) Int. Cl.
*F16L 3/00* (2006.01)

(52) U.S. Cl. ..... 248/121

(58) Field of Classification Search ..... 248/121, 248/127, 694; 5/655; 128/869
See application file for complete search history.

(56) References Cited

U.S. PATENT DOCUMENTS 16,862 A * 3/1857 Thomas ..... 482/68
D43,907 S * 4/1913 Liu ..... D11/162
2,229,411 A * 1/1941 Hughes ..... 297/487
3,747,596 A * 7/1973 Mills ..... 128/869
5,033,131 A 7/1991 Paden
5,367,724 A * 11/1994 Coccagna ..... 4/571.1
5,380,262 A * 1/1995 Austin ..... 482/68
5,433,682 A * 7/1995 Fermaglich et al. ..... 482/66
5,664,828 A * 9/1997 Simon ..... 297/153
6,158,065 A 12/2000 Tuoriniemi
6,932,709 B1 * 8/2005 Gubitosi et al. ..... 472/118

* cited by examiner

*Primary Examiner* — Ramon Ramirez

(57) ABSTRACT

An apparatus for stabilizing, with respect to a grounded surface, an infant standing on a horizontal surface, the apparatus comprising: a grounded support structure configured for transmitting a ground force from the grounded surface; an outer support structure, operably coupled to the grounded support structure, configured for receiving the ground force and transmitting an outer support force; a connecting structure, disposed inside and operably coupled to the outer support structure, configured for receiving the outer support force and transmitting a connecting force; and an inner support structure, disposed inside and operably coupled to the connecting structure, configured for being disposed around the torso of the infant and for receiving the connecting force and transmitting a stabilizing force to the infant, there being no obstruction between the inner support structure and the horizontal surface.

13 Claims, 2 Drawing Sheets

METHOD AND APPARATUS FOR STABILIZING A STANDING INFANT

CROSS-REFERENCE TO RELATED APPLICATIONS

This application claims the benefit of the filing date of the provisional application titled "Method And Apparatus For Stabilizing A Standing Infant"; inventor Evelyn Tristao; U.S. application Ser. No. 61/277,874; filing date Sep. 30, 2009, the entire contents of which are hereby included by reference.

BACKGROUND

The present invention relates generally to the field of infant care equipment and more specifically to the field of apparatus for helping to stabilize an infant while standing.

In a variety of situations, once some infants begin to develop an ability to stand, these infants also develop a preference for standing over either sitting or lying down. Despite the inability to stand unaided, or the inability to stand aided for an extended time, these infants will exhibit a behavior wherein continued expression of this preference results in eventually falling to the ground. This behavior is particularly worrisome to caregivers attempting, for example, to bathe such infants in a bathtub or shower, to dress such infants, or simply to prevent such infants from walking or crawling away when caregiver attention is directed elsewhere.

Opportunities exist, therefore, to develop an apparatus which: provides a handhold, stably coupled to a grounded surface, to aid in standing; allows the infant to be largely self-supporting to help develop strength and balance; prevents the infant from striking the ground if attempts at standing should fail; and allows access to the infant by caregivers.

SUMMARY

The opportunities described above are addressed, in one embodiment of the present invention, by an apparatus for stabilizing, with respect to a grounded surface, an infant standing on a horizontal surface, the apparatus comprising: a grounded support structure configured for transmitting a ground force from the grounded surface; an outer support structure, operably coupled to the grounded support structure, configured for receiving the ground force and transmitting an outer support force; a connecting structure, disposed inside and operably coupled to the outer support structure, configured for receiving the outer support force and transmitting a connecting force; and an inner support structure, disposed inside and operably coupled to the connecting structure, configured for being disposed around the torso of the infant and for receiving the connecting force and transmitting a stabilizing force to the infant, there being no obstruction between the inner support structure and the horizontal surface.

Another aspect of the present invention is embodied by a method for stabilizing, with respect to a grounded surface, an infant standing on a horizontal surface, the method comprising the acts of: transmitting a ground force from the grounded surface; receiving the ground force and transmitting an outer support force; receiving the outer support force and transmitting a connecting force; and receiving the connecting force and transmitting a stabilizing force to the infant using an inner support structure, there being no obstruction between the inner support structure and the horizontal surface.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
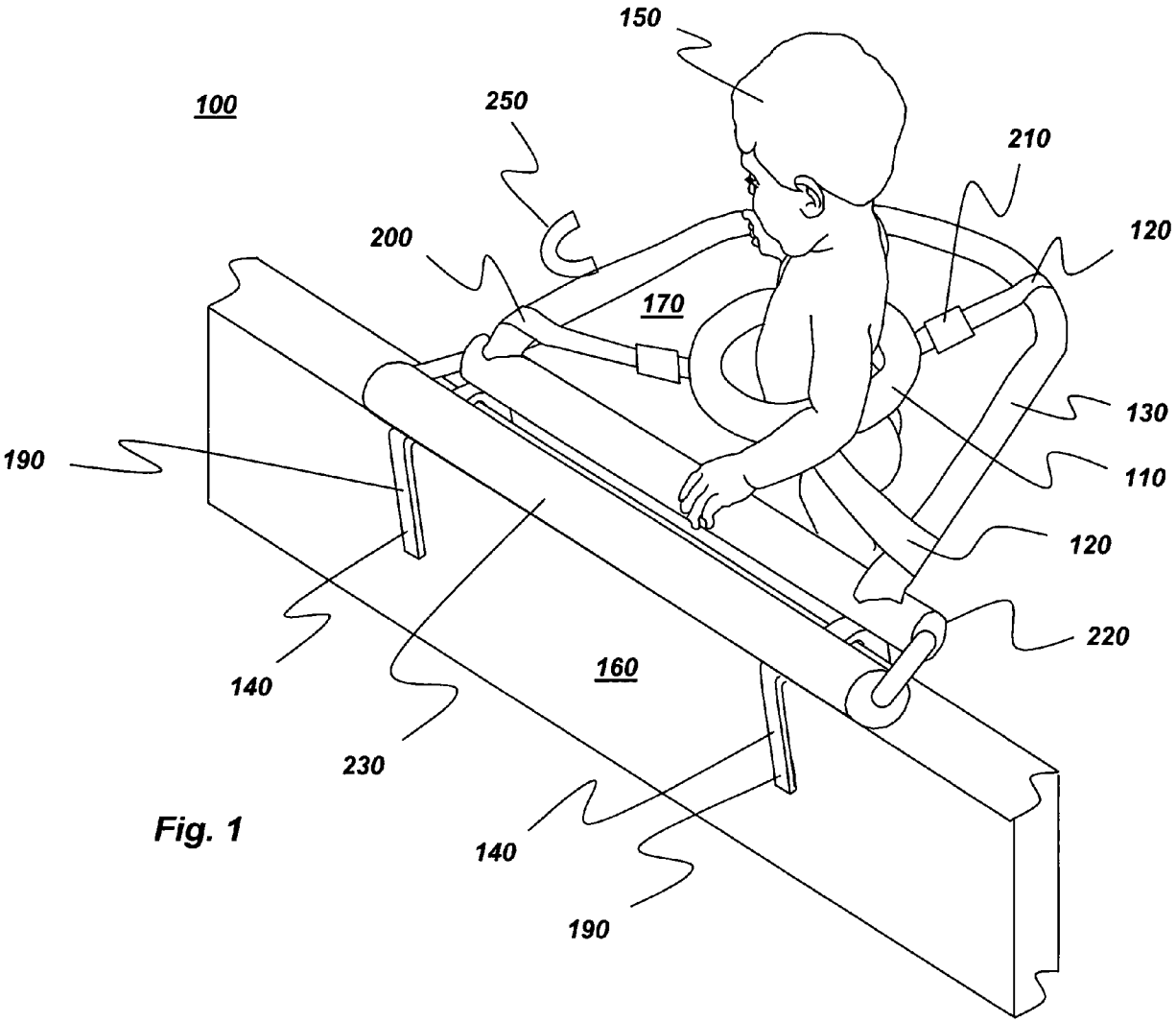
FIG. 1 is a perspective drawing illustrating an apparatus in accordance with one embodiment of the present invention.

In accordance with one embodiment of the present invention, FIG. 1 is a perspective drawing illustrating an apparatus 100 for stabilizing an infant 150, with respect to a grounded surface 160, while infant 150 stands on a horizontal surface 170. As used herein, "stabilizing" refers to the acts either of providing a grounded structure for infant 150 to lean on, or of transmitting a force from the ground to infant 150 to lessen any impact during a fall.

Apparatus 100 comprises a grounded support structure 140, an outer support structure 130, a connecting structure 120, and an inner support structure 110. In operation, infant 150 initially balances by grasping or leaning on outer support structure 130. If balance is lost, however, then grounded support structure 140 transmits a ground force from grounded surface 160. Outer support structure 130, operably (for example, mechanically) coupled to grounded support structure 140, receives the ground force and in turn transmits an outer support force. The outer support force is received by connecting structure 120. Disposed inside and operably coupled to outer support structure 130, connecting structure 120 then transmits a connecting force. Finally, inner support structure 110, disposed inside and operably coupled to connecting structure 120, receives the connecting force and transmits a stabilizing force to infant 150. Inner support structure 110 is disposed around the torso of infant 150, typically underneath the arms and above the waist, loosely enough to allow infant 150 freedom of motion, but closely enough to catch infant 150 (i.e., to transmit a stabilizing force) before striking horizontal surface 170. Notably, there is no obstruction (for example, a seat or harness) between inner support structure 110 and horizontal surface 170.

In a more detailed embodiment in accordance with the embodiment of FIG. 1, inner support structure 110 has the shape of a circular ring.

In another more detailed embodiment in accordance with the embodiment of FIG. 1, grounded surface 160 is a vertical wall (for example, a bathtub wall) and grounded support structure 140 comprises a wall clamp 190. In operation, wall clamp 190 fits over the top of the vertical wall providing a cantilevered coupling to grounded surface 160.

In another embodiment in accordance with the embodiment of FIG. 1, apparatus 100 further comprises a padded fender 220 removably coupled to outer support structure 130. Padded fender 220 is disposed so as to prevent contact of infant 150 with the vertical wall.

In another embodiment in accordance with the embodiment of FIG. 1, apparatus 100 further comprises a padded armrest 230 removably coupled to padded fender 220. Padded armrest 230 is disposed so as to prevent contact of a caretaker's arm with a top surface of the vertical wall.

In a more detailed embodiment in accordance with the embodiment of FIG. 1, apparatus 100 connecting structure 120 comprises a plurality of elastic straps 200. In some embodiments, apparatus 100 further comprises a plurality of strap couplers 210, operably coupled to elastic straps 200 and inner support structure 110. Strap couplers 210 allow the tension in elastic straps 200 to be adjusted.

In another embodiment in accordance with the embodiment of FIG. 1, apparatus 100 further comprises a water sprayer holder 250 operably coupled to outer support structure 130. In operation, water sprayer holder 250 holds a water sprayer (for example, a hand-held shower head).

Figure 2:
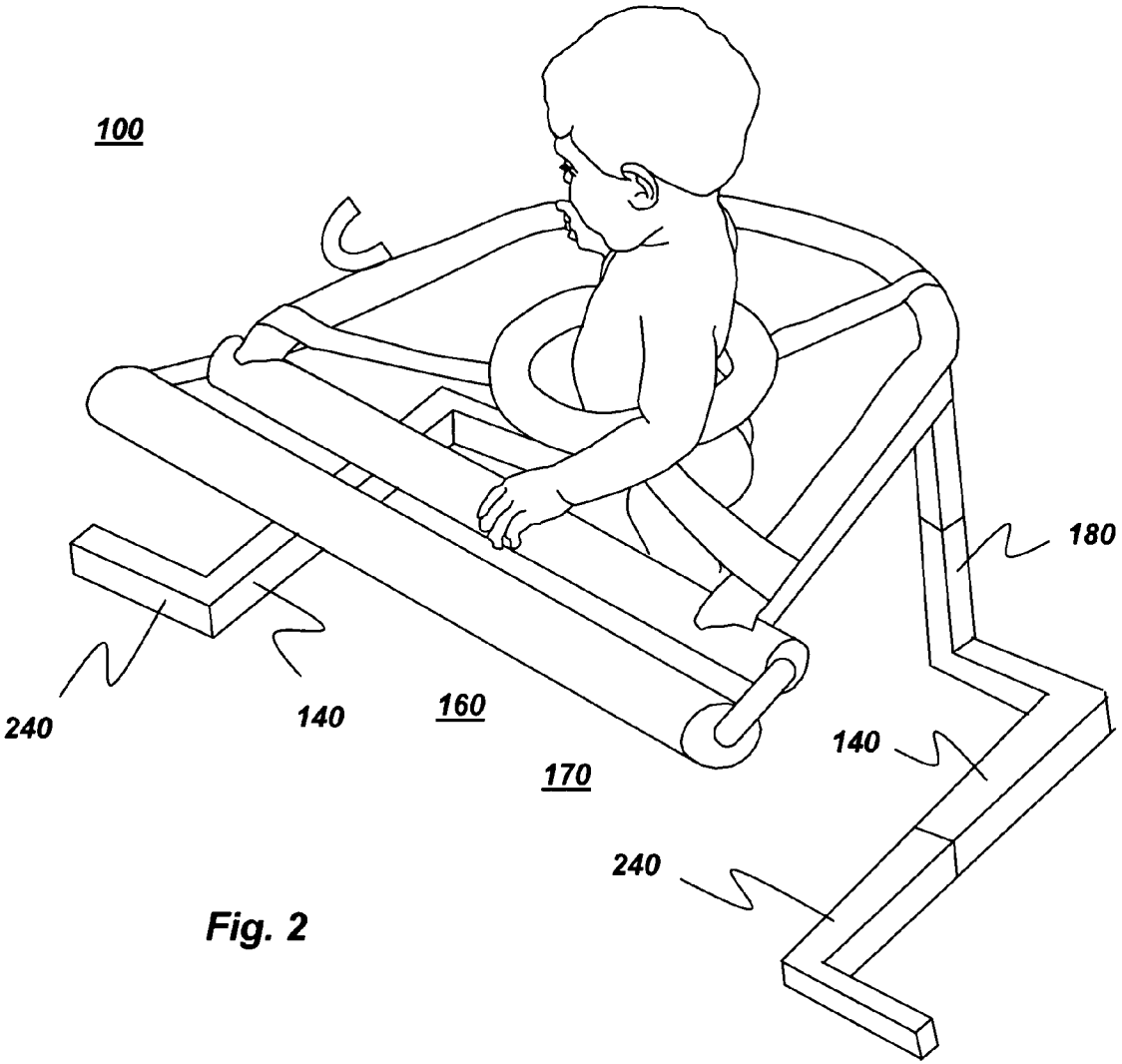
FIG. 2 is a perspective drawing illustrating an apparatus in accordance with an alternative embodiment of the present invention.

In accordance with an alternative embodiment of the present invention, FIG. 2 is a perspective drawing illustrating apparatus 100 wherein horizontal surface 170 and grounded surface 160 are identical and grounded support structure 140 comprises at least one support leg 180.

In another embodiment in accordance with the embodiment of FIG. 2, apparatus 100 further comprises an extended foot 240. Extended foot 240 is mechanically coupled to support leg 180, and, in operation, transmits the ground force from grounded surface 160. In some embodiments, extended foot 240 is fashioned to be adjustable in length.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An apparatus for stabilizing, with respect to a grounded surface, an infant standing on a horizontal surface, said apparatus comprising:

a grounded support structure configured for transmitting a ground force from said grounded surface;

an outer support structure, operably coupled to said grounded support structure, configured for receiving said ground force and transmitting an outer support force;

a connecting structure, disposed inside and operably coupled to said outer support structure, configured for receiving said outer support force and transmitting a connecting force; and an inner support structure, disposed inside and operably coupled to said connecting structure, configured for being disposed around the torso of said infant and for receiving said connecting force and transmitting a stabilizing force to said infant, there being no obstruction between said inner support structure and said horizontal surface, said grounded surface being a vertical wall, said grounded support structure comprising a wall clamp configured for cantilevered coupling to said grounded surface.

2. The apparatus of claim 1 wherein said inner support structure has the shape of a circular ring.

3. The apparatus of claim 1 further comprising a padded fender removably coupled to said outer support structure, disposed and configured for preventing contact of said infant with said vertical wall.

4. The apparatus of claim 3 further comprising a padded armrest removably coupled to said padded fender, disposed and configured for preventing contact of a caretaker's arm with a top surface of said vertical wall.

5. The apparatus of claim 1 wherein said connecting structure comprises a plurality of elastic straps.

6. The apparatus of claim 5 further comprising a plurality of strap couplers, operably coupled to said elastic straps and said inner support structure, configured for adjusting tension in said elastic straps.

7. The apparatus of claim 1 further comprising a water sprayer holder, operably coupled to said outer support structure, configured for holding a water sprayer.

8. A method for stabilizing, with respect to a grounded surface, an infant standing on a horizontal surface, said method comprising the acts of:

transmitting a ground force from said grounded surface;

receiving said ground force and transmitting an outer support force;

receiving said outer support force and transmitting a connecting force, using a connecting structure; and receiving said connecting force and transmitting a stabilizing force to said infant using an inner support structure, there being no obstruction between said inner support structure and said horizontal surface, cantilevering said grounded support structure from said grounded surface, said grounded surface being a vertical wall.

9. The method of claim 8 wherein said inner support structure has the shape of a circular ring.

10. The method of claim 8 further comprising the act of preventing contact of said infant with said vertical wall using a padded fender.

11. The method of claim 10 further comprising the act of preventing contact of a caretaker's arm with a top surface of said vertical wall using a padded armrest.

12. The method of claim 8, said connecting structure comprising a plurality of elastic straps, further comprising the act of adjusting tension in said elastic straps.

13. The method of claim 8 further comprising the act of holding a water sprayer.

* * * * *